US005898152A

United States Patent [19]

Kim

[11] Patent Number: 5,898,152

[45] Date of Patent: Apr. 27, 1999

[54] ARC CHUTE ASSEMBLY FOR CIRCUIT BREAKER

[75] Inventor: Hak Jin Kim, Cheongju, Rep. of Korea

[73] Assignee: LG Industrial Systems Co., Ltd., Seoul, Rep. of Korea

[21] Appl. No.: 09/000,955

[22] Filed: Dec. 30, 1997

[30] Foreign Application Priority Data

Dec. 31, 1996 [KR] Rep. of Korea ..... 1996 67738

[51] Int. Cl.[6] ..... H01H 33/02; H01H 9/30

[52] U.S. Cl. ..... 218/149; 218/15; 218/81; 218/156; 335/201

[58] Field of Search ..... 218/15, 34, 41, 218/76, 77, 81, 149, 150, 151, 156; 335/201

[56] References Cited

U.S. PATENT DOCUMENTS 4,107,497 8/1978 Jencks et al. ..... 218/15
4,446,347 5/1984 Eguchi et al. ..... 218/15
5,247,142 9/1993 Yonkovitz et al. ..... 218/15
5,539,365 7/1996 Lepretre et al. ..... 335/201

*Primary Examiner*—Lincoln Donovan
*Attorney, Agent, or Firm*—Oliff & Berridge, PLC.

[57] ABSTRACT

An arc chute assembly for a circuit breaker includes a plurality of U-type grids respectively including an engagement protrusion extended from each side thereof, the engagement protrusion having a key pin opening formed therethrough, a plurality of side walls respectively including a plurality of engagement slots formed therethrough, and a key pin inserted through corresponding ones of the key pin openings formed through the engagement protrusions which are inserted through the side walls and extended to an extent from an outer surface of each of the side walls. The apparatus employs the key pin for fixing the grids to the side walls, thereby facilitating assembly steps as well as decreasing an assembly time thereof.

10 Claims, 3 Drawing Sheets

ARC CHUTE ASSEMBLY FOR CIRCUIT BREAKER

BACKGROUND OF THE INVENTION

1. Field of the Invention

The present invention relates to a circuit breaker, and more particularly to an arc chute assembly for a circuit breaker which facilitates an assembly between grids and sidewalls.

2. Description of the Background Art

As shown in FIG. 1, a general circuit breaker includes a case 10 formed of an insulation resin material. Inside the case 10 there are provided a trip apparatus and a switching apparatus therein.

The trip apparatus includes a bimetal 20 and a heater 40 disposed below the bimetal 20 and having a fixing core 30 attached thereto. The heater 40 is connected to a load terminal base 50.

The case 10 also includes an amateur 60 disposed at a side portion of the bimetal 20 and having a protrusion (not shown) on each side of the central portion thereof, thereby being operated back and forth while being fixed to a wall of the case 10.

At this time, the bimetal 20 and the amateur 60 are respectively formed of a plurality of pairs thereof. A protrusion (not shown) formed on upper portions of the bimetal 20 and the amateur 60 is provided adjacent to a strip cross bar 70 formed across a side thereof.

At a side portion of the trip cross bar 70 there is formed a protrusion (not shown) with regard to the bimetal 20 and the amateur 60, that is, a protrusion 70*a* which corresponds to respective poles, and at another side portion of the trip cross bar 70 there is formed a protrusion which is to push a latch holder 80.

Also, the switching apparatus is formed of a mechanical unit operated in accordance with the trip apparatus, and of a stable contact 90 and a movable contact 100.

The stable contact 90 is attached to an upper portion of the stable contact point 120 coupled to the source terminal base 110, and the movable contact 100 is attached to a lower surface of the movable contact point 130.

Also, a holder 140 a side portion of which is connected to the movable contact point 130 is coupled to a shaft 150 formed along an elongated axis.

At this time, the movable contact point 150 is movable upwardly and downwardly having as its center a stable shaft 170 connected to a side plate 160. An arc extinguishing chamber formed of grids 180, arc runner grids (not shown) and side walls (not shown) is provided outside an operational space of the movable contact point 150. Here, an arc becomes extinct in the arc extinguishing chamber.

The mechanical unit is formed of a pair of bimetal 20 and amateur 60 disposed at a central pole thereof, and it also includes a latch 190 moving upwardly and downwardly on the axis of the latch pin 160*a* fixed to the side plate 160, and a latch holder 80 a side portion of which is hooked on the latch 190 and another side portion of which is coupled to the trip cross bar 70.

At a side portion of the holder 140 there is provided a toggle link 200 connected by use of the holder pin 140*a*. An upper link 220 is connected to the link pin 210 at an upper portion of the toggle link 200 by a side portion thereof, and coupled to the latch 190 using the upper link pin 220*a* by another side portion thereof.

Here, the link pin 210 is hooked on the spring 240 attached to the lever 230, and a manual manipulation handle 250 is attached to the lever 230.

The thusly constituted general circuit breaker is a mechanical device for protecting an overflow of current onto a low pressure internal electrical path, and it is reusable after a circuit breaking operation thereof with regard to a switching function of load current and breakdown current.

The current flow steps in a normal condition of the circuit breaker follow the steps of: current terminal base 100→stable contact point 120→stable contact 90→movable contact 100→movable contact point 130→heater 30→load terminal base 50.

However, when there occurs a charge current such as an overcurrent which exceeds a rated current at the circuit breaker, or a short current, the operation of the circuit breaker is as follows.

When there flows an overcurrent that exceeds a rated current through the circuit breaker, the bimetal 20 becomes crooked so that the bimetal 20 carries out a trip operation as a delay trip operation in which the trip cross bar 70 is pushed in a slow mode, and when there occurs a charge current such as a short current, there occurs a strong magnetic field at the fixing core 30. Due to the strong magnetic field, a lower portion of the amateur 60 becomes instantly sucked and at the same time the protrusion (not shown) formed at an upper portion of the amateur 60 comes to press the trip cross 70 as an instant trip operation in which the trip operation is instantly executed.

By use of such a delay trip operation of the bimetal 20 or such an instant trip operation of the amateur 60, when the bimetal 60 or the amateur 60 presses the trip cross bar 70, the trip cross bar 70 becomes rotated, and accordingly when the latch holder 80 is pushed, the latch 190 hooked on the latch holder 80 is released and at the same time the upper link 220 and the toggle link 200 are bent in accordance with the tension of the spring 240 which pulls the link pin 210.

As the upper link 220 and the toggle link 200 are bent, the holder 140 connected to the toggle link 200 by the holder pin 140*a* and the movable contact point 130 abruptly springs up, thereby opening the stable contact 90 and the movable contact 100.

The holder 140 and the movable contact point 130 are connected in common to the shaft 150 which is connected to the respective poles, so that in accordance with the pole-opening of the stable contact 90 and the movable contact 100 with regard to the central pole the shaft 150 allows other contacts with regard to the respective poles to simultaneously be opened.

At this time, the stable contact 90 and the movable contact 100 are pole-opened and at the same tim there occurs an arc discharge between the stable contact 90 and the movable contact 100.

The thusly generated arc discharge stays for a short while in the stable contact 90 and then the arc discharge moves to the arc extinguishing chamber in accordance with a sudden upward bouncing of the movable contact point 130 as a sudden disconnection.

Then, as the movable contact point 130 moves to an upward direction, the stable contact point 120 becomes further distanced from the movable contact point 130, and accordingly the arc moves toward an internal portion of the grids 180 by an electromagnetic force generated between the grids 180 in the arc extinguishing room and the arc current.

The arc that has moved inside the grids 180 are serially partitioned according to the grids aligned on every other floor therein, and the arc resistance becomes rapidly increased and accordingly the arc voltage becomes rapidly increased by related factors, such as a cathode effect of the grids 180 in which when the arc comes into the arc extinguishing chamber, the grids 180 are respectively turned to positive poles or negative poles, a cooling effect in which the arc is partitioned into shorter arcs between the grids 180 and extinguished in the air by cooling, and a pressure effect according to an arc energy by an increased magnetic flux density with regard to a pressure increase in the arc extinguishing chamber.

When the arc voltage surpasses the source voltage, it becomes difficult for the arc voltage to maintain the arc voltage so that the arc is extinguished. Accordingly, there occurs a voltage corresponding to the source voltage between the stable contact 90 and the movable contact 100, thereby carrying out the circuit breaking operation.

The conventional arc chute assembly for extinguishing the arc will now be described with reference to FIGS. 2 and 3.

The conventional arc chute assembly includes a plurality of grids 180 formed of U-shaped metallic plates for inducing magnetism, and a plurality of side walls 280 formed of insulation material.

The grids 180 respectively include a plurality of engagement protrusions 180*a* extended from each side thereof and cut off by the respective centers thereof. The side walls 280 includes a plurality of slots 280*a* for receiving corresponding ones of the engagement protrusions 180*a*.

The combining steps between the grids 180 and the side walls 280 for forming the arc extinguishing chamber will now be described.

The grids 180 including the engagement protrusions 180*a* are fixed using a gig and then the grids 180 are respectively inserted into a corresponding one of the engagement slots 280*a* formed in the side walls 280. In order for the grids 180 not to escape from the side walls 280, the side walls 280 are bound by a rubber string.

The respective cut-off portions of the engagement protrusions 180*a* are opened to each side thereof by employing a rivetting process, thereby fixing the grids 180 to the side walls 280.

Likewise, the plurality of grids 180 are stacked with a space therebetween between the side walls 280, and the assembled arc chute assembly is mounted in the arc extinguishing chamber provided in the circuit breaker.

However, the conventional arc chute assembly allows the grids 180 to be inserted into the side walls 280, and in order for the grids 180 not to be released from the side walls the side walls 280 are fixed by use of a rubber string and there is further followed a rivetting process for the fixture, thereby disadvantageously increasing processing steps as well as requiring an increased working time.

SUMMARY OF THE INVENTION

Accordingly, it is an object of the present invention to provide an arc chute assembly for a circuit breaker which facilitates assembly processing steps by simplifying an assembly structure.

To achieve the above-described object, there is provided an arc chute assembly for a circuit breaker according to the present invention which includes a plurality of U-type grids respectively including an engagement protrusion extended from each side thereof, the engagement protrusion having a key pin opening formed therethrough, a plurality of side walls respectively including a plurality of engagement slots formed therethrough, and a key pin inserted through corresponding ones of the key pin openings formed through the engagement protrusions which are inserted through the side walls and extended to an extent from an outer surface of each of the side walls.

The object and advantages of the present invention will become more readily apparent from the detailed description given hereinafter. However, it should be understood that the detailed description and specific example, while indicating a preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become better understood with reference to the accompanying drawings which are given only by way of illustration and thus are not limitative of the sent invention, wherein.

DETAILED DESCRIPTION OF THE PREFERRED EMBODIMENTS

With reference to the accompanying drawings, the arc chute assembly for a circuit breaker according to the present invention will now be described.

Figure 1:
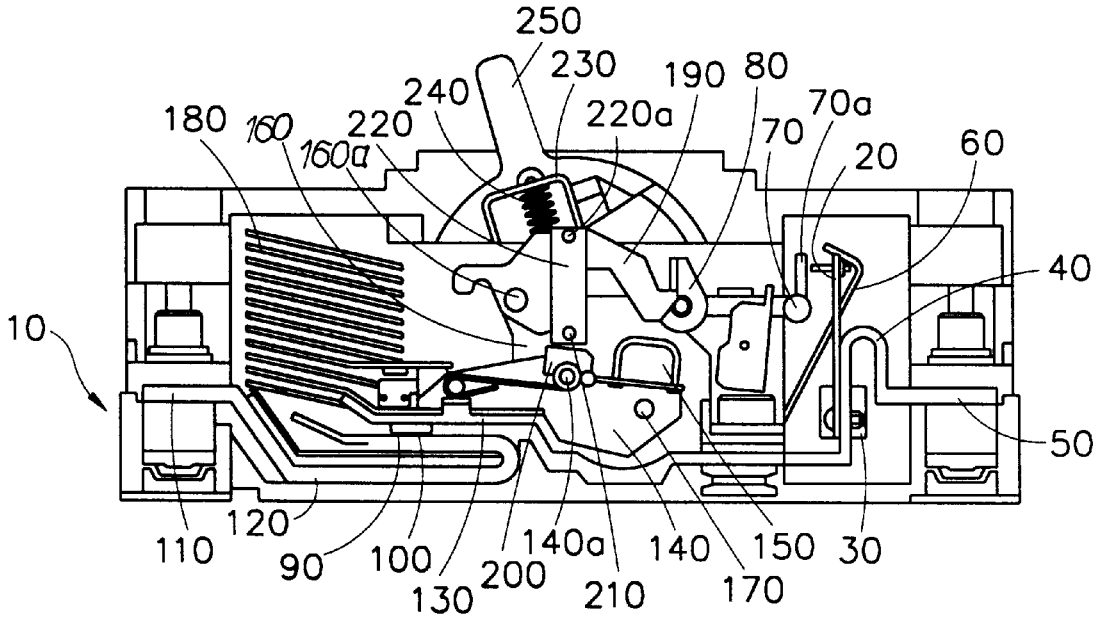
FIG. 1 CONVENTIONAL ART
FIG. 1 sectional view illustrating a general circuit breaker.
Figure 2:
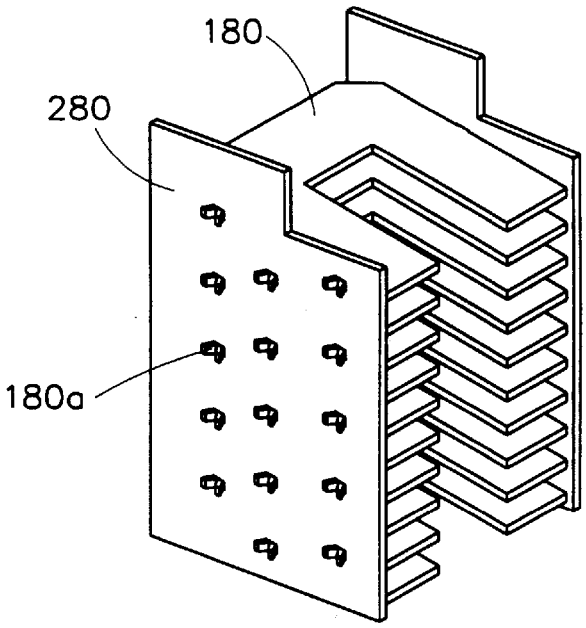
FIG. 2 CONVENTIONAL ART
FIG. 2 a perspective view illustrating an arc chute assembly for a circuit breaker according to a conventional art.
Figure 3:
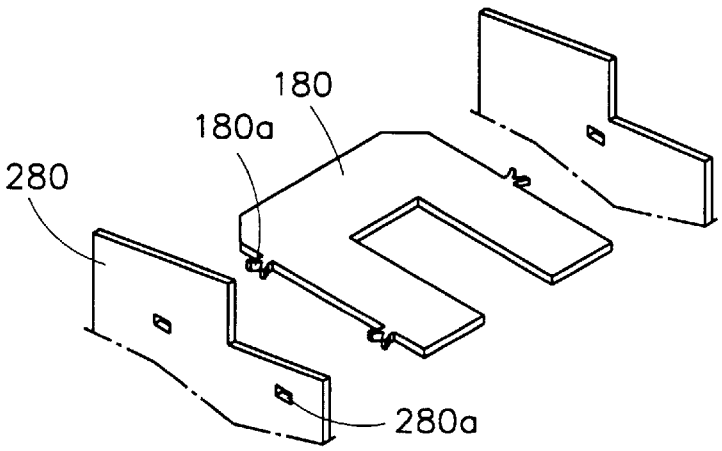
FIG. 3 CONVENTIONAL ART
FIG. 3 is a partially exploded perspective view illustrating an assembly process of the arc chute assembly for a circuit breaker according to the conventional art.
Figure 4:
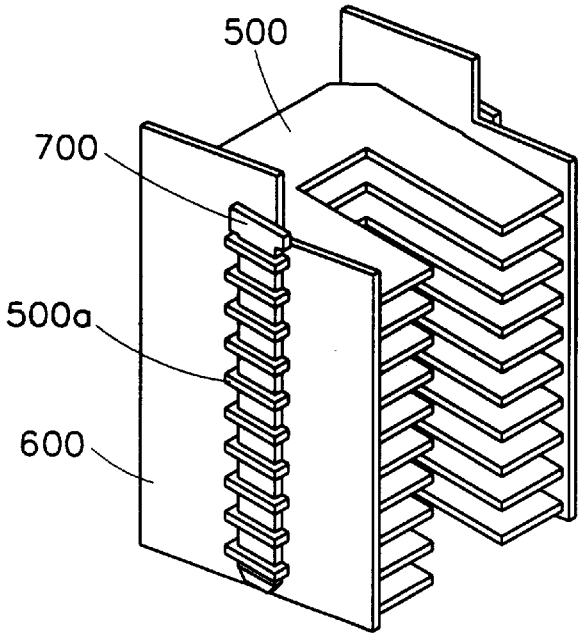
FIG. 4 is a perspective view illustrating an arc chute assembly for a circuit breaker according the present invention.
Figure 5:
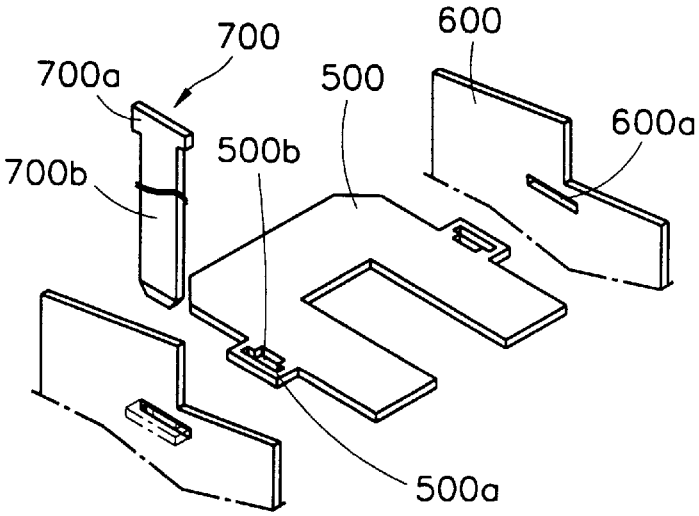
FIG. 5 is a partially exploded perspective view illustrating an assembly process of the arc chute assembly for a circuit breaker according to the present invention.

As shown in FIGS. 4 and 5, the arc chute assembly for a circuit breaker according to the present invention includes a plurality of U-type grids 500, and a pair of side walls 600 for supporting the grids 500 provided therebetween.

Each of the grids 500 includes an engagement protrusion 500*a* extended from each side thereof. The engagement protrusion 500*a* has a key pin opening 500*b* formed in a car shape therethrough.

A plurality of rectangular slots 600*a* are formed through each of the pair of side walls 600 so as to receive corresponding ones of the engagement protrusions 500*a* of the grids 500.

The arc chute assembly for a circuit breaker according to the present invention includes a key pin 700 for being inserted through the key pin openings 500*b* of the engagement protrusions 500*a* which are to be inserted through the insertion slots 600*a* formed in each of the side walls 600.

The T-shaped key pin openings 500*b* are to obtain a sufficient space during the insertion of the key pin 700 therethrough. Here, a lower rectangular opening of each of the T-shaped key pin openings 500*b* corresponds in shape to a cross-section of the key pin 700.

The key pin openings 500*b* may be formed circular or semicircular and accordingly a cross-section of the key pin 700 also becomes circular or semicircular.

The engagement slots 600*a* are respectively formed identical to a shape of a front view of the engagement protrusion 600*a*.

The key pin 700 formed of an insulation material has a head portion 700*a* serving as a stopper which is larger than a lower portion of the key pin 700. A stem 700*b* corresponds in width to the key pin opening 500*b*, and a lower end portion of the key pin 700 is formed narrow so as to facilitate the insertion thereof into the key pin openings 500*b*.

The assembly steps of the arc chute assembly for a circuit breaker according to the present invention will now be described.

First, the grids 500 are fixed using a gig, and the engagement protrusions 500*a* of the grids 500 are inserted into the engagement slots 600*a* in the side walls 600.

Then, the respective grids 500 are inserted into the engagement slots 600*a* in the side walls 600, and the key pin 700 is fixedly inserted from up to down through the key pin openings 500*b* externally extended through the side walls 600.

At this time, the head portion 700*a* of the key pin 700 is hooked onto each side portion of a top one of engagement openings 500*a* so as not to be downwardly released.

As described above, the arc chute assembly for a circuit breaker according to the present invention employs the key pin for fixing the grids to the side walls, thereby facilitating assembly steps as well as decreasing an assembly time thereof.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within meets and bounds of the claims, or equivalences of such meets and bounds are therefore intended to embrace the appended claims.

What is claimed is:

1. An arc chute assembly for a circuit breaker, comprising:

a plurality of U-type grids respectively including an engagement protrusion extended from each side thereof, said engagement protrusion having a key pin opening formed therethrough;

a plurality of side walls respectively including a plurality of engagement slots formed therethrough; and a key pin inserted through corresponding ones of the key pin openings formed through the engagement protrusions, the engagement protrusions being inserted through the side walls and extended to an extent from an outer surface of each of the side walls.

2. The assembly of claim 1, wherein the key pin openings are respectively similar in shape to a cross-section of the key pin.

3. The assembly of claim 1, wherein the key pin openings are respectively formed in a T shape with each key pin opening provided in a corresponding one of the engagement protrusions and wherein a horizontal portion of each T-shaped opening is formed at an outer side with respect to a portion in which the engagement protrusion is protruded from the grid.

4. The assembly of claim 3, wherein the shape of the horizontal portion of the T-shaped key pin opening is formed identically in shape to a cross-section portion of the key pin.

5. The assembly of claim 1, wherein the engagement slots in the side walls are respectively similar in shape to a front view of each of the engagement protrusions extended from the grids.

6. The assembly of claim 1, wherein the key pin includes a larger head portion in width than a stem portion thereof, the stem being identical in width to the key pin opening, and a lower end portion of the key pin being narrower than the stem portion thereof.

7. The assembly of claim 1, wherein the key pin openings are respectively circular.

8. The assembly of claim 1, wherein the key pin openings are respectively semicircular.

9. The assembly of claim 1, wherein a cross-section of the key pin is circular.

10. The assembly of claim 1, wherein a cross-section of the key pin is semicircular.

* * * * *